United States Patent [19]

Bubniak et al.

[11] 4,337,738

[45] Jul. 6, 1982

[54] VALVE CONTROL MECHANISM

[75] Inventors: William C. Bubniak, Troy; Harry R. Mitchell, Bloomfield Hills, both of Mich.

[73] Assignee: General Motors Corporation, Detroit, Mich.

[21] Appl. No.: 588,333

[22] Filed: Jun. 19, 1975

[51] Int. Cl.[3] ..... F02D 13/06

[52] U.S. Cl. ..... 123/198 F; 123/90.16; 123/90.41; 123/90.43

[58] Field of Search ..... 123/198 F, 198 R, 1 R, 123/DIG. 1, DIG. 7, 90.32, 90.41, 90.43, 90.15, 90.16, 90.17; 251/77, 78

[56] References Cited

U.S. PATENT DOCUMENTS

| | | | |
|---|---|---|---|
| 794,683 | 7/1905 | Riotle | 123/198 F |
| 948,248 | 2/1910 | Reaugh | 123/198 F |
| 1,331,787 | 2/1920 | Schatler | 123/198 F |
| 1,350,989 | 8/1920 | Cox | 123/198 F |
| 1,358,459 | 11/1920 | Pache | 123/198 F |
| 1,797,105 | 3/1931 | Shoblom | 123/90.41 X |
| 2,392,933 | 1/1946 | Mallory | 123/198 F |
| 2,528,983 | 11/1950 | Weiss | 123/198 F |
| 2,808,818 | 10/1957 | Sampietro | 123/90.43 |
| 2,853,984 | 9/1958 | Sampietro | 123/90.43 |
| 2,863,430 | 12/1958 | Sampietro | 123/90.43 |
| 3,009,450 | 11/1961 | Engemann | 123/90.43 |
| 3,147,745 | 9/1964 | Kilgore | 123/90.43 |
| 3,169,515 | 2/1965 | Kilgore et al. | 123/90.43 |
| 3,422,803 | 1/1969 | Stivender | 123/90.16 |
| 3,964,455 | 6/1976 | Brown | 123/90.43 |

FOREIGN PATENT DOCUMENTS

| | | | |
|---|---|---|---|
| 864080 | 4/1941 | France | 123/198 F |

*Primary Examiner*—Ira S. Lazarus
*Attorney, Agent, or Firm*—Arthur N. Krein

[57] ABSTRACT

A valve control mechanism for effecting split engine operation of an internal combustion engine of the overhead valve type in which each valve is actuated by a rocker arm normally fulcrummed intermediate its ends on an apertured pivot bearing slidably supported on a mounting stud fixed to the cylinder head of the engine, with one end of the rocker arm engaging the stem of the valve to be actuated and its other end being engaged by a reciprocating push rod, the valve control mechanism including a slider support fixed to the mounting stud above the rocker arm, a spring engaged between the slider support and the pivot bearing to normally bias the pivot bearing toward an operative position whereat the rocker arm is pivotable about the pivot bearing, a stepped slider slidably supported by the slider support for movement between a first position at which the pivot bearing is in its operative position relative to the rocker arm and a second position permitting movement of the rocker arm to a position at which the rocker arm is then fulcrummed on the end of the valve stem and, power means operatively connected to the slider to selectively move the slider between the first position and the second position.

16 Claims, 4 Drawing Figures

VALVE CONTROL MECHANISM

This invention relates to a valve control mechanism for an internal combustion engine and, in particular, to a valve control mechanism for effecting split engine operation.

A split engine and its basic mode of operation has previously been disclosed in U.S. Pat. No. 2,954,022 entitled "Split Engine" issued Sept. 27, 1960 to Stanley H. Mick. As explained in the aforenoted patent, it has been found that considerable economy can be realized when it is possible to resort to split engine operation, for example, being able to operate an 8-cylinder engine on four cylinders under moderate load conditions. The economy is effected by the fact that individual cylinder efficiency is increased when the individual cylinder load is increased during split engine operation, in contrast to reduced cylinder loads as would occur with full engine operation during light or moderate load conditions.

It is an inherent characteristic of an internal combustion engine to be most efficient under high load conditions. This is attributable to the quantity of air fed to the cylinders. Maximum air is supplied to the cylinders when the throttle is open, indicative of high loads, therefore, more air may be compressed in turn increasing the compression ratio. Since engine efficiency increases with compression pressure and compression pressure increases with cylinder load, the desirability of split or part cylinder engine operation as a means for maintaining high cylinder load becomes apparent.

However, in the known prior art systems, when engine operation has been shifted from, for example, 8-cylinder operation to 4-cylinder operation, some of the benefits to be gained by 4-cylinder operation have been lost due to the fact that some work is being continuously performed in the unloaded cylinders of the engine.

Accordingly, it is the primary object of this invention to provide an improved valve operating mechanism for effecting split engine operation whereby the valves for preselected cylinders of the engine can be rendered operative or inoperative, as desired.

Another object of this invention is to provide a valve control mechanism for an internal combustion engine that is adapted to automatically shift engine operation between, for example, 8-cylinder and 4-cylinder operation as a function of engine load by effecting the operation or non-operation of both the intake and the exhaust valves for preselected cylinders of the engine so that little or no work is performed in the cylinder associated with these valves when they are inactivated.

A further object of this invention is to provide an improved valve operating mechanism for effecting split engine operation whereby a resiliently biased slider is used to position a pivot bearing to effect activation of a valve.

These and other objects of the invention are obtained by means of a valve control mechanism used to control the operation or non-operation of the valves for preselected cylinders of an internal combustion engine of the overhead valve type. In this valve control mechanism, a poppet valve is normally actuated by a rocker arm, one end of which engages the stem of the valve while its opposite end is actuated by a reciprocating push rod, the rocker arm intermediate its ends being normally fulcrummed by a pivot bearing that is slidably mounted on a support stud and is normally biased to a position on the support stud by a spring so as to serve as the pivot for the rocker arm. A slider support is fixed to the support stud above the rocker arm to slidably receive a stepped slider that is moved between a first position at which it abuts against the pivot bearing to retain it in an operative position to permit the rocker arm to pivot about the pivot bearing in a normal fashion and to a second position permitting the pivot bearing to move upon engagement by the rocker arm to permit movement of the rocker arm so that it is then fulcrummed on the end of the valve stem and is inoperative to effect opening of the valve and, power means are operatively connected to the slider to selectively move the slider between the first position and the second position.

For a better understanding of the invention, as well as other objects and further features thereof, reference is had to the following detailed description of the invention to be read in connection with the accompanying drawings, wherein.

Figure 1:
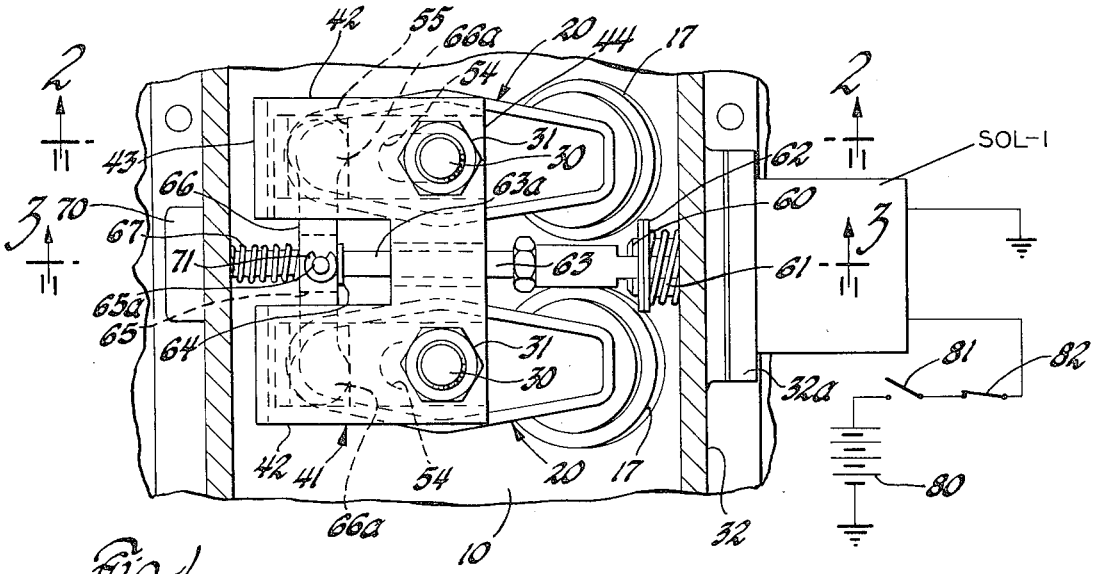
FIG. 1 is a top view, partly in section and partly schematic, showing a portion of an internal combustion engine having incorporated therein a valve control mechanism in accordance with the invention to control operation of both the intake valve and the exhaust valve for a cylinder of the engine, the elements being shown in position to deactivate the cylinder of the engine.

The invention will be described with reference to an 8-cylinder internal combustion engine, although it will be apparent that the invention can be applied to engines having any number of cylinders in excess of one so that split engine operation can be effected.

It will be apparent that in such an engine, the alternate firing cylinders would probably be selected for active or inactive cylinders, as desired. In other words, for an 8-cylinder engine having a normal firing order of, for example, 1-8-4-3-6-5-7-2, the active cylinder can then be, for example, cylinders 1-4-6-7, while the remaining cylinders would then be those which would be either active or inactive depending on engine load in a manner to be described.

Referring now to the subject matter of the invention, in the embodiment of the invention illustrated, the valve control mechanism of the invention is used to render active or inactive both the intake valve and the exhaust valve for a cylinder. Thus, there is shown a valve control mechanism in accordance with the invention associated with the cylinder of an internal combustion engine, this cylinder being either an active or inactive cylinder, as desired, of the engine.

The engine is of the conventional overhead valve type and includes a cylinder head 10, having a passage 11 therein in communication with a cylinder, not shown, the passage being either an induction passage or an exhaust passage for the cylinder.

Flow between the passage 11 and the cylinder is controlled by a poppet valve 12, the valve stem 14 of which is slidably guided for axial reciprocation in the guide bore 15 provided for this purpose in the cylinder head, with the upper end 14*a* of the valve stem projecting above the cylinder head. In a conventional manner, the valve 12 is normally maintained in a closed position by a spring 16 encircling the upper portion of the stem 14, with one end of the spring engaging the cylinder head and the other end engaging a conventional retaining washer 17 suitably secured to the stem of the poppet valve.

Opening of the valve 12 is effected by a rocker arm, generally designated 20, that is actuated by a reciprocating push rod 21 journaled in the push rod guide bore 22 in the cylinder head 10, the push rod being disposed laterally of the valve stem with its upper end projecting above the cylinder head. The lower end of the push rod 21 would be operated in a conventional manner by a cam, not shown, effecting reciprocal movement of the push rod.

Thus, the push rod 21 and valve 12 are operatively connected by the rocker arm 20 that is formed with arms 23 and 24 overlying and resting upon the upper ends 14*a* and 25 of the valve stem and push rod, respectively. Adjacent the outer end of its arm 24, the bottom surface of the rocker arm is spherically dished to socketably receive the upper end 25 of the push rod in bearing relation. Intermediate its ends, the rocker arm 20 is provided with a spherically dished bearing portion 26, the upper surface of which socketably receives the pivot bearing 27 having a correspondingly shaped bottom bearing surface forming a semi-spherical pivot bearing for the rocker arm. Centrally of the bearing portion 26, the rocker arm 20 is provided with an aperture 28 through which extends an elongated mounting or support stud 30 having its lower end suitably fixed in the cylinder head 10, the upper end of this stud 30 being threaded to receive a retainer nut 31.

Figure 2:
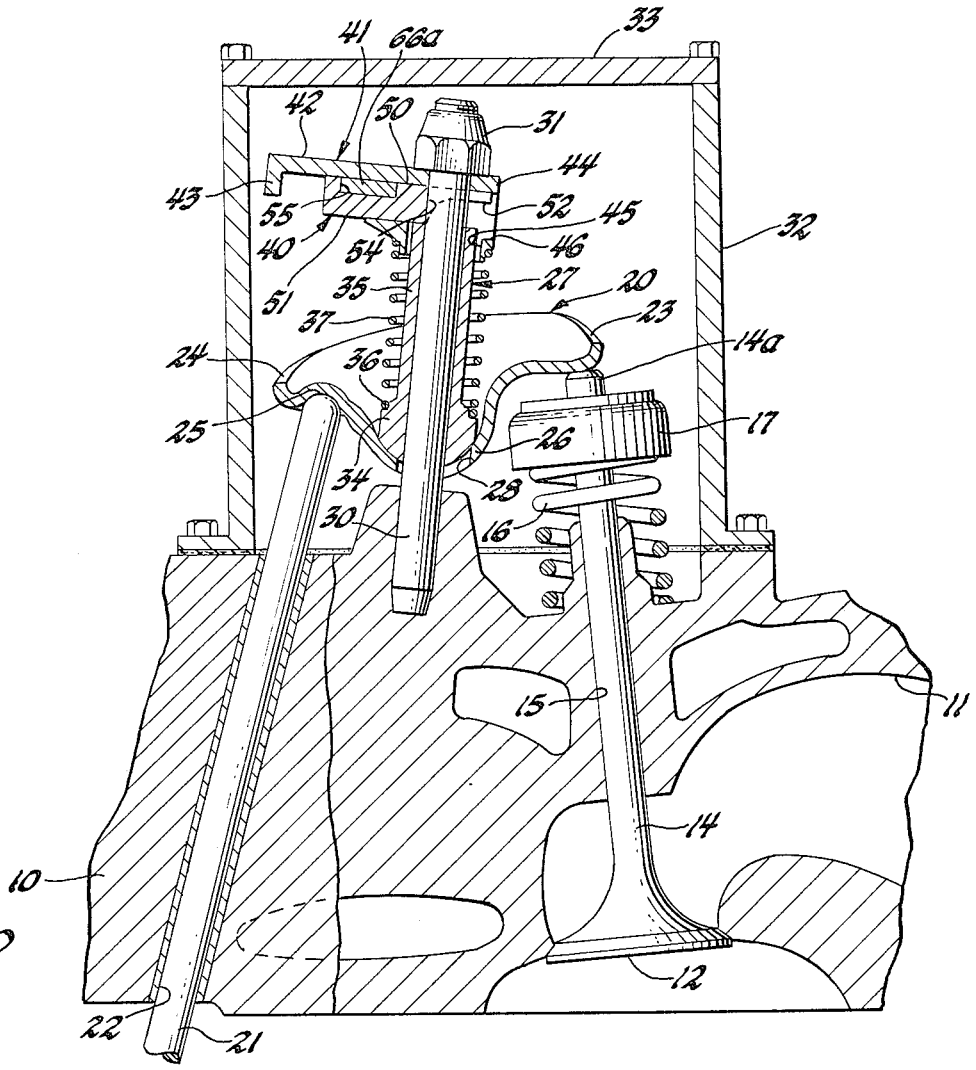
FIG. 2 is a view taken along line 2—2 of FIG. 1, but with the elements of the mechanism shown in position for activation of the cylinder with the rocker arm positioned to effect opening movement of the valve upon actuation of the rocker arm by the push rod.

The valve mechanism, as thus far broadly described, is conventional in that, as shown in FIG. 2, the rocker arm 20 is positioned to be fulcrummed intermediate its ends on the pivot bearing 27, so that upon actuation of the push rod 21, the rocker arm would be caused to pivot about the pivot bearing 27 with its arm 23 engaging the stem of the poppet valve to effect opening of this poppet valve.

Now for the purpose of this disclosure, it can be assumed that the poppet valve shown in FIG. 2 would be the inlet valve and thus, with reference to FIG. 1, this would be the valve at the top of this figure and the other valve would, of course, be the exhaust valve. Since the elements, thus far described, would be similar for both the intake valve and the exhaust valve, it is not deemed necessary for the purpose of this disclosure, to illustrate or describe in detail these same elements as they relate to the exhaust valve. Accordingly, like parts shown in FIG. 1 will be identified with like reference numerals.

All of the valves in the cylinder head for one bank of cylinders of the engine are enclosed by a valve train cover which, in the embodiment shown, includes an outer peripheral enclosure wall 32 suitably secured to the cylinder head 10 and a cover plate 33 for this enclosure wall which is suitably secured to the top thereof, this arrangement being used to facilitate assembly of the components of the valve control mechanism that are still to be described.

In accordance with the invention, the pivot bearing 27 is of tubular construction having a lower semi-spherical bearing portion 34 and a cylindrical upper portion 35 of reduced diameter with an annular radial shoulder 36 therebetween. The bore through the pivot bearing is of a diameter whereby to permit the pivot bearing to slidably encircle the support stud 30 for movement axially thereon between a first position, the position shown in FIG. 2, at which it is in operative position to act as a fixed pivot about which the rocker arm 20 is pivoted and a second position, the position shown in FIG. 4, at which it is in inoperative position relative to the rocker arm to permit movement of the rocker arm to a position whereat the rocker arm will then pivot about its end 23 on the top 14*a* of the valve stem.

To selectively retain the pivot bearing 27 in the first position and to permit movement of the pivot bearing to the second position, a stepped spacer or slider 40 is suitably slidably supported by a slider support 41, fixed to a support stud 30 above the rocker arm 20, for sliding movement at right angle to the support stud, the pivot bearing 27 being positioned between the slider 40 and the rocker arm. The pivot bearing 27 is normally biased toward the first position, the position shown in FIG. 2, by a coiled spring 37 encircling the cylindrical upper portion 35 of the pivot bearing 27, with one end of the spring abutting against the radial shoulder 36 and its other end abutting against the bottom side of the slider support 41, which is retained against axial movement in one direction, upward with reference to FIGS. 2 and 4, by the retainer nut 31. The spacer or slider 40, when in operative position relative to the pivot bearing 27, is operative to properly space the pivot bearing on the support stud in position to permit normal operation of the rocker arm to effect opening of the valve 12.

In the embodiment disclosed, since both the intake and exhaust valves for each cylinder of the engine shown are positioned in side by side relationship, the slider support 41 in this embodiment is adapted for use with both valves. Thus, as shown, the slider support 41 is U-shaped in plan view and includes spaced apart parallel legs 42 connected together at one end by a web 44, with each of the legs 42 terminating at their free ends in a depending flange 43 and at their opposite ends in an enlarged portion integral with the web 44. Web 44 is provided with spaced apart through stepped apertures 45 at right angle to the legs 42 whereby to receive the support studs 30 on which the rocker arms for both the inlet and exhaust valves are mounted. With this arrangement, the slider support 41 is retained against rotation relative to both support studs. It is to be realized that if it is desired to provide for activation and deactivation of only one valve, the slider support used in such an arrangement would have to be provided with some suitable means to prevent rotation of the slider support relative to the support rod, for a purpose which will become apparent. The web 44 is also provided with a pair of spaced apart through guide slots 46 that extend at right angle to the stepped apertures 45, the sides of these slots extending parallel to the sides of the legs 42 and through the enlarged portions of these legs, each to receive a slider 41. In addition, the web 44 of the slider support 41 is provided with a through guide bore 47 located midway between the slots 46 and parallel thereto to receive a guide bushing 48 for a purpose to be described.

Figure 3:
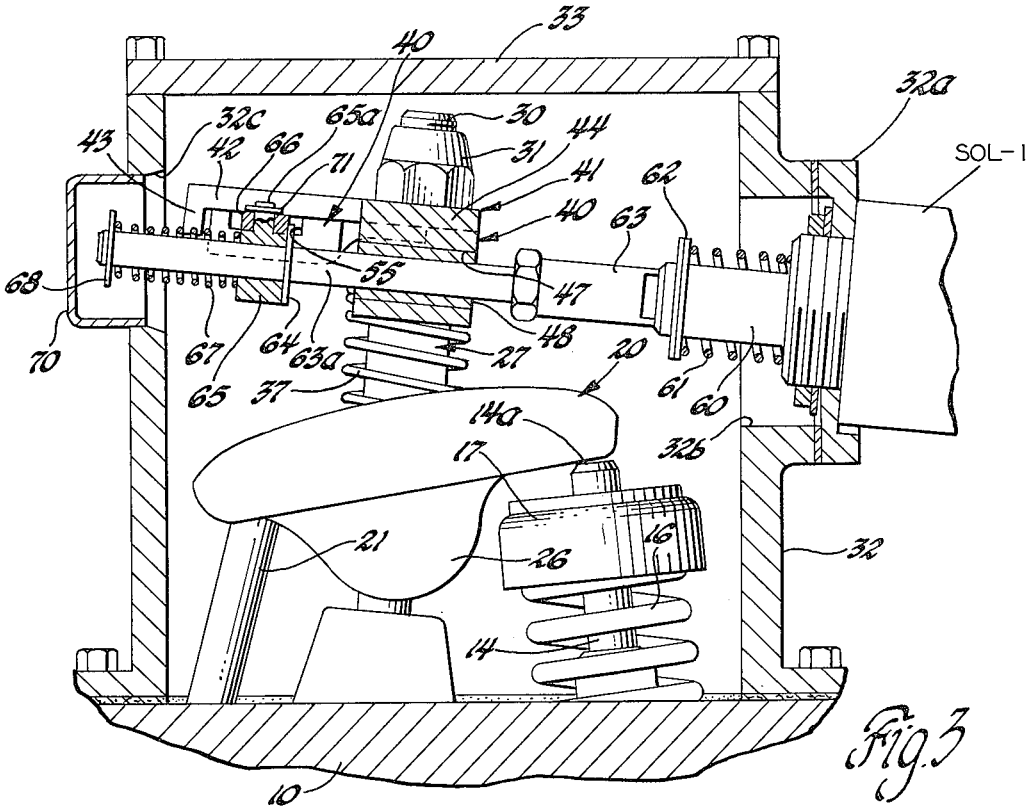
FIG. 3 is a sectional view taken along line 3—3 of FIG. 1.

Each slider 40 is of a rectangular, elongated bar of a cross section size and shape corresponding to the cross section of the slots 46 to be slidable therein, each slider having parallel longitudinal sides, a connecting flat upper surface 50 and a stepped bottom surface, the latter including a first bottom surface 51 in spaced parallel relation to the upper surface at one end of the slider and a second bottom surface 52 at the other end of the slider, the second bottom surface also being in spaced parallel relation to the upper surface but much closer spaced thereto than the first bottom surface by a predetermined distance, and an inclined cam surface 53 extending between the first bottom surface and the second bottom surface. Each slider is also provided with an elongated slot 54 extending longitudinally from the reduced thickness end of the slider, the slot defining parallel side surfaces extending from the free reduced thickness end of the slider and terminating at an arcuate shaped portion that is formed complementary to the support rod, this inboard end of the slot terminating at the junction of the inclined cam 53 surface with the first bottom surface 51. The width of the slot is suitably greater than the outside diameter of the support rod 30 so as to permit this slotted end of the slider to slidably encircle the support rod 30 with which it is associated, but this width is less than the outside diameter of the cylindrical upper portion 35 of the pivot bearing so that with the slider in the first position, as seen in FIG. 3, the upper end of the pivot bearing 27 will abut against the bottom surface 51. Each slider, as thus described, has in effect a bifurcated end of reduced height which terminates by a connecting cam surface at the nominal height main body portion of the slider. The upper surface 50 of each slider is also provided with a transversely extending recess 55 defined by a flat bottom wall and spaced apart, transversely extending side walls, for a purpose to be described.

A suitable power means, including spring biasing means, is operatively connected to the sliders 40 to effect the selective movement of these sliders between their first position and second position, previously described. In the embodiment disclosed, the power means, as best seen in FIGS. 1 and 3, includes a solenoid SOL-1 suitably secured by a mounting bracket 32*a* to a wall on the valve side of the enclosure wall 32, with the armature 60 of the solenoid positioned to extend through an aperture 32*b* in this wall, the armature extending parallel to and between the planes extending through the axes of the respective sets of valves and push rods. The armature 60 is normally biased to an extended position, the position shown in FIGS. 1 and 3, relative to the core of the solenoid when the solenoid is de-energized by a coiled spring 61, of a predetermined force, encircling the armature 60 with one end of the spring abutting against the body of the solenoid and the other end abutting against a retaining washer means 62 suitably fixed on the armature adjacent to its free end.

An adjustable length, cylindrical, actuator rod 63 is reciprocally guided intermediate its ends in the bushing 48 of the slider support 41 and is rigidly secured at one end to the free end of the armature and concentric therewith to, in effect, form an extension of the armature. The reduced diameter portion 63*a* of the actuator rod 63 is provided on the free end of this rod projecting beyond the bushing 48 with a fixed radial flange 64 to provide an abutment shoulder for an apertured guide block 65 that is slidably mounted on the actuator rod and pivotally connected to a connecting rod 66 thereby providing an operative connection between the actuator rod 63 and the sliders 40. The guide block 65 is thus slidably mounted on the actuator rod 63 on the opposite side of the radial flange 64 from the solenoid and it is normally biased into abutment against the radial flange 64 by a coiled spring 67, of predetermined force, encircling the free end of the actuator rod between the guide block 65 and a retainer 68 fixed adjacent to the free end of the actuator rod.

In the embodiment disclosed, in order to limit the distance between the longitudinally extending side walls of the enclosure wall 32, the wall of the enclosure wall opposite to that on which the solenoid is mounted is provided with an opening 32*c* to allow the free end of the actuator rod 63 to extend therethrough, the opening being closed by a cup-shaped closure element 70, secured as by press fit, therein.

Referring now to the connecting rod 66, this rod as best seen in FIG. 1 is a flat rod provided at its opposite ends with semi-circular pivot ends 66*a*, as viewed from the top of this rod, one such end 66*a* being slidably and pivotably received in the recess 55 in the slider for the intake valve and the other such end 66*a* of the connecting rod being slidably and pivotably received in the corresponding recess for the slider for the exhaust valve, these ends being loosely sandwiched between the flat bottom of each recess 55 in the slider and the underside surface of the leg 42 with which the slider is associated. Intermediate its ends, midpoint in the embodiment shown, the connecting rod 66 is pivotally connected to the guide block 65, as by having the upright pin 65*a* of the guide block extending through a suitable aperture provided in the connecting rod and retained relative to the connecting rod by a split ring retainer 71 positioned in a suitable annular groove provided for this purpose in the pin 65*a* adjacent to its free end.

As shown in FIG. 1, the solenoid SOL-1 is connected to a voltage source 80 for operation through the vehicle ignition switch 81 and a normally closed switch 82 that is suitably operable as a function indicative of engine load. For example, switch 82 may be a pressure switch positioned to sense the pressure of hydraulic fluid used to engage the direct drive clutch in a conventional automatic transmission, not shown, connected in a known manner to the engine. The switch 82 would then be operable to open the circuit to de-energize the solenoid when the transmission is in the high drive ratio and to keep the switch closed completing the circuit to maintain the solenoid energized whenever the transmission is in a low drive ratio. Switch 82 would then be similar to that presently used on vehicle ignition timed control systems, such a system being known commercially as a transmission controlled spark system and may be of the type described in U.S. Pat. No. 3,584,521 entitled "Ignition Timing Control" issued June 15, 1971 to Robert S. Tooker and James J. Dawson.

During engine operation, assuming that switch 82 is connected as previously described, to the transmission, not shown, of the vehicle, switch 81 would, of course, be closed and switch 82 would also be closed during the low drive mode of operation so that the solenoid SOL-1 would be energized and, the elements of the valve control mechanism would then be in the position shown in FIG. 2. In this position of the elements, the armature 60 of the solenoid would be retracted with the armature spring 61 compressed, and of course the actuator rod 63 which moves with the armature would then be in a position allowing the spring 67 to bias and retain the sliders 40 in their operative positions to serve as a spacer for the pivot bearings, the spring 67 acting through the guide block 65 and the connecting rod 66 on the sliders. In this operative position of the sliders, as shown in FIG. 2, the pivot bearing 27 is axially positioned on the support rod 30, as defined by engagement of the upper end of the pivot bearing against the bottom surface 51 of the slider 40, in a position whereby the pivot bearing can act as the fulcrum about which the rocker arm 20 pivots as oscillated by the reciprocating motion of the push rod 21 thereby effecting corresponding reciprocal motion of the valve 12 to effect opening movement of this valve.

When the transmission is at a high drive ratio mode of operation, indicative of a light engine load, switch 82 would be caused to open to thereby de-energize the solenoid SOL-1. With the solenoid de-energized, the spring 61, which has a spring force, as desired, sufficiently greater than the force of the spring 67, is operative to effect extension of the armature 60 relative to the coil of the solenoid, that is, to move the armature to the position shown in FIGS. 1 and 3, the armature carrying with it the actuator rod 63. As this occurs, the radial flange 64 on the actuator rod, in abutment against the guide block 65, will carry the guide block and, therefore, the connecting rod in a direction whereby to, in effect, withdraw each slider out of engagement with its pivot bearing 27. That is, each slider 40 is moved from the position shown in FIG. 2 to that shown in FIGS. 1, 3 and 4 with its reduced end portion containing the bottom surface 52 then positioned above its related pivot bearing whereby to permit the pivot bearing to then move axially upward on its support stud 30 a distance as limited by engagement of the upper end of the pivot bearing against the bottom surface 52 of the slider 40 which distance is sufficient to then allow the rocker arm to pivot about the stem of the associated valve instead of about the pivot bearing.

Figure 4:
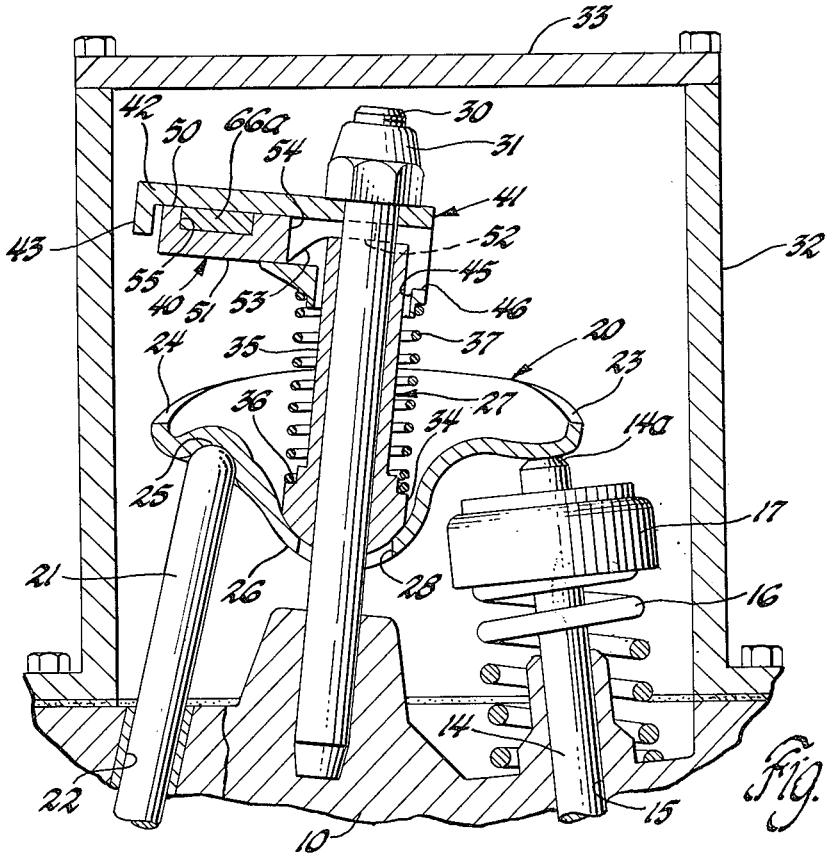
FIG. 4 is a view similar to that of FIG. 2 but showing the position of the various elements of the valve mechanism whereby the rocker arm is positioned so as to not effect operation of the valve.

Now during reciprocation of the push rod and as it moves upward to the position shown in FIG. 4, since the force of the return spring 16 of valve 12 is greater than the force of spring 37 encircling the pivot bearing, the valve 12 will remain closed and the rocker arm 20 is then fulcrummed for pivotal movement about the upper end 14*a* of the valve since the pivot bearing 27 is now free to move axially upward on its support rod against the biasing action of the spring 37, to the position shown in this figure.

When switch 82 is again closed, as previously described, to energize the solenoid to retract the armature, the actuator rod is also moved axially to the right from the position shown in FIG. 3. As this occurs, spring 67 is then free to bias the guide block 65 toward a position in which it is then in abutment against the radial flange 64, the spring, through the connections previously described, resiliently urging each of these sliders to move toward their first position, that is, toward the engaged position shown in FIG. 2, as permitted by the reciprocation of the push rod for the valve train with which the slider is associated. With the arrangement shown, each slider 40 is free to move independently of the other, since the connecting rod is free to pivot intermediate its ends about the axis of the pin 65*a* of guide block 65 and the connecting rod is free at each end to have the semicircular end portions of the connecting rod independently pivotable in the respective recess in which the end is engaged.

Thus, as the push rod of a valve is at the bottom of its stroke, the spring 37 for the pivot bearing 27 associated with that valve will bias the pivot downward along the support rod 30 while at the same time, the associated slider 40 is urged in a direction so that the cam portion 53 thereof will engage the upper end of the pivot bearing to assist in forcing it downward until the pivot bearing reaches the position shown in FIG. 2 at which the upper end of the pivot bearing is then once again engaged against the bottom surface 51 of the slider and properly spaced thereby, the pivot bearing thus being once again positioned whereby it can act as the fulcrum about which the associated rocker arm 20 pivots as oscillated by the reciprocating motion of the push rod 21 thereby once again effecting corresponding reciprocal motion of the associated valve 12 to effect opening movement of this valve.

Now in the case of an 8-cylinder engine in which four cylinders are to be either active or inactive, a valve control mechanism, as thus described, would be provided for each of the cylinders selected to be either active or inactive, with all of the solenoids for the mechanisms connected to a common power source 80 through an ignition switch 81 and a common switch 82, as previously described, these connections being made in a well-known manner.

As previously described, returning to the normal valve operation involves insertion of a spacer in the gap provided by the pivot bearing 27 movement along the support stud 30. Once the spacer or slider 40 is positioned in this gap, the valve train is restored to its conventional state with all components operating at normal desired loads and travel conditions. Since the spacer-gap is constantly varying and is a different height at each valve at a given time, the spacer or slider 40 must be eased into and out of position through a spring device, such as the spring 67 and related components shown. This is accomplished, in the embodiment disclosed, by positioning connecting rod 66 along the length of the cylinder head adjacent to the support studs for a pair of valves, as shown, to control individual valve action. Thus, for each cylinder, the spring 67 will act upon the connecting rod to push the sliders 40 for the intake valve and the exhaust valve into position when the gap for the respective valve opens sufficiently.

During the time that the cylinders are deactivated, the entire valve train, as disclosed, for each cylinder remains taut so that none of the components can move out of position or clatter.

What is claimed is:

1. In an internal combustion engine having a cylinder head and reciprocally journaled therein a poppet valve with a return spring connected thereto and a reciprocally driven member for operating the poppet valve in a direction opposed by its spring with each stroke of the member in a direction substantially opposite that of the poppet valve, a rocker for normally transmitting valve operating movement from the member to the poppet valve, said rocker having spaced apart surfaces on one side thereof engageable with oppositely facing surfaces of the member and the poppet valve and a bearing portion intermediate its ends with a bearing surface on the opposite side of said rocker from said spaced apart surfaces, said bearing portion having an aperture therethrough, a support stud extending through said aperture and fixed at one end to said cylinder head, an aperture pivot bearing slidably supported on said support stud and provided with a seat, said pivot bearing being movable axially on said support stud from a first position at which said seat pivotally journals said bearing surface about the rocking axis of said rocker to a second position at which said rocker is movable to a position at which it is pivotally supported by the oppositely facing surface of the poppet valve and, power means, including spring means, responsive to engine operating conditions, to effect movement of said pivot bearing to selectively position said seat at said first position and at said second position.

2. In an internal combustion engine having a cylinder head and reciprocably journaled therein a poppet valve with a return spring operatively connected thereto and a reciprocally driven member for operating the poppet valve in a direction opposed by its spring, a rocker for normally transmitting valve operative movement from said driven member to said poppet valve, said rocker having spaced apart surfaces on one side thereof engageable with oppositely facing surfaces of the said driven member and said poppet valve and a bearing portion intermediate its ends with a semi-spherical bearing surface on the opposite side of said rocker from said spaced apart surfaces, said bearing portion having an aperture therethrough, a stud fixed to said cylinder head and extending through said aperture, a bearing seat means having an aperture therethrough slidably journaled on said stud for movement from a first position at which one end of said bearing seat means pivotally supports said rocker for pivotal movement about said bearing seat means to a second position at which said rocker is movable to a position at which it is pivotally supported by the oppositely facing surface of said poppet valve, a spacer retaining member fixed to said stud, a stepped spacer slidably supported by said spacer retaining member, the opposite end of said bearing seat means being engageable by said stepped spacer, a spring operatively connected to said spacer retaining member and to said bearing seat means normally biasing said bearing seat means to said first position, said stepped spacer being movable in said spacer retaining member between an engaged position relative to said bearing seat means to retain said bearing seat means in said first position and a non-engaged position in which said bearing seat means is free to move to said second position against the biasing action of said spring and, selectively operable power means, including spring means, responsive to engine operating conditions operably connected to said spacer to effect selective movement of said spacer between said engaged position and said non-engaged position.

3. In an internal combustion engine having a cylinder head and reciprocally journaled therein an intake valve and an exhaust valve with a return spring operatively connected to each valve and a reciprocally driven member for each valve operating each valve in a direction opposed by its spring, a rocker for each valve normally transmitting valve operative movement from one of said driven members to one of said valves, each said rocker having spaced apart surfaces on one side thereof engageable with oppositely facing surfaces of the one of said driven members and one of said valves and a bearing portion intermediate its ends with a semi-spherical bearing surface on the opposite side of said rocker from said spaced apart surfaces, said bearing portion having an aperture therethrough, a pair of studs fixed to said cylinder head, each said stud extending through one of said aperture in said rockers, a pair of tubular pivot bearings each slidably journaled on one of said studs for movement from a first position at which one end of a said pivot bearing pivotally supports one of said rockers for pivotal movement about said pivot bearing to a second position at which said rocker is movable to a position at which it is pivotally supported by the oppositely facing surface of said valve with which it is associated, a slider support means fixed to said studs, a pair of stepped sliders individually slidably supported by said slider support in spaced apart relation to each other, the opposite end of said pivot bearing being engageable by said stepped sliders, a pair of springs, each said spring being operatively connected to said axial retaining member and to one of said bearing pivots to normally bias said pivot bearing to said first position, each said stepped slider being movable in said spacer retaining member between an engaged position relative to said pivot bearing to retain said pivot bearing in said first position and a non-engaged position in which said pivot bearing is free to move to said second position against the biasing action of said spring and, selectively operable power means including spring means connected to each said stepped slider to effect movement of each said stepped slider between said engaged position and said non-engaged position, said power means being operative in response to engine operating conditions.

4. In an internal combustion engine according to claim 3 wherein said slider support is of U-shape configuration and includes a web means with stepped bores therethrough through which said studs extend and, integral arm means extending from said web means at right angle to and aligned with said studs, said web means having spaced apart slots extending therethrough in alignment with said arms and intersecting said stepped bores, wherein each stepped slider is bifurcated at one end, said bifurcated end being of reduced height as compared to the rest of said stepped slider, and each said stepped slider is provided with a transverse recess on its upper side adjacent to its opposite end, each said stepped slider being slidably received in one of said slots in said web means with its upper surface in sliding abutment against one of said arms and with its said bifurcated end positioned to slidably receive said stud with which it is associated relative thereto and, wherein said power means is responsive to engine operating conditions and includes an actuator rod movable axially in opposite directions, said actuator rod having a radial flange thereon, an apertured guide block slidably supported on said actuator rod, spring means fixed at one end to said actuator rod and having its other end in abutment against said guide block to normally bias said guide block into abutment with said radial flange and, a connecting rod pivotally secured intermediate its ends to said guide block for movement therewith, said connecting rod having its opposite ends operatively engaged in said recesses of said sliders to effect movement of said stepped sliders.

5. An internal combustion engine having a cylinder head and at least one poppet valve axially reciprocal against a return spring in timed valve opening and closing movements, a member reciprocable in relation to the cylinder head in timed valve opening and closing directions for driving the poppet valve in such movement, a lever arm positioned for connecting said member to the poppet valve, releasable fulcrum means operatively associated with the cylinder head, said releasable fulcrum means including an element positioned for movement between an unreleased and a released position and being operative in the unreleased position to define a fulcrum for said lever arm whereby said lever arm operatively connects said member to the poppet valve so that the poppet valve is moved in timed valve opening and closing movements by said member, said element when in said released position permitting movement of said lever arm by said member to a position effecting operating disengagement between said member and the poppet valve and, control means operatively connected to said releasable fulcrum means for selective positioning of said element in said unreleased position and said released position.

6. An internal combustion engine having a cylinder head and at least one poppet valve axially reciprocal against a return spring in timed valve opening and closing movements, a member reciprocable in relation to the cylinder head in timed valve opening and closing directions for driving the poppet valve in such movements, a lever arm positioned for connecting said member to the poppet valve, releasable fulcrum means operatively associated with the cylinder head, said releasable fulcrum means including an element positioned for movement between an unreleased and a released position and being operative in the unreleased position to define a fulcrum for said lever arm whereby said lever arm operatively connects said member to the poppet valve so that the poppet valve is moved in timed valve opening and closing movements by said member, said element when in said released position permitting movement of said lever arm thereby effecting operating disengagement between said member and the poppet valve, said releasable fulcrum means further including a post upstanding from the cylinder head by which said element is movably supported, a compression spring element telescoped over said post and seating at the end proximate to the cylinder head on said element and at its other end being fixed against axial movement relative to said post, and a releasable element means positioned for engagement with the end of said element distal to the cylinder head whereby to define said unreleased position, said releasable element means being releasable relative to said element to permit axial movement of said element along said post to said released position and, control means operatively connected to said releasable element means to effect selective movement of said element to said unreleased position or said released position.

7. In an internal combustion engine having a cylinder head and reciprocally journaled therein a poppet valve with a return spring connected thereto and a reciprocally driven member for operating the poppet valve in a direction opposed by its spring with each stroke of the member in a direction substantially opposite that of the poppet valve, a rocker for normally transmitting valve operating movement from the member to the poppet valve positioned for engagement with the member and the poppet valve, a post upstanding from the cylinder head, a releasable pivot means slidably supported by said post and movable axially relative to said post from a first position at which said releasable pivot means defines a fulcrum for said rocker to a second position at which said rocker is released for movement to a position at which it is pivotally supported by the poppet valve and, actuator means, operatively connected to said releasable pivot means to effect movement of said releasable pivot means to selectively sequentially position said releasable pivot means at said first position and at said second position.

8. In an internal combustion engine having a cylinder head and reciprocably journaled therein a poppet valve with a return spring operatively connected thereto and a reciprocally driven member for operating the poppet valve in a direction opposed by its spring, a rocker for normally transmitting valve operative movement from said member to said poppet valve, a post fixed to said cylinder head and extending outward therefrom, a pivot means slidably supported by said post for movement from a first position at which one end of said pivot means pivotally supports said rocker for pivotal movement to effect operation of said poppet valve by said member to a second position at which said rocker is movable to a position at which it is inoperative for effecting operation of said poppet valve, a spacer retaining member fixed relative to said post, a movable spacer means operatively supported by said post, the opposite end of said pivot means being engageable by said spacer means, a spring operatively connected to said spacer retaining member and to said pivot means for normally biasing said pivot means to said first position, said spacer means being movable between an engaged position relative to said pivot means at which said pivot means is retained in said first position and a non-engaged position at which said pivot means is free to move to said second position against the biasing action of said spring and, selectively operable actuator means operably connected to said spacer means to effect movement of said spacer from said engaged position to said non-engaged position relative to said pivot means.

9. In a machine having improved means varying the amount of valve opening in a valve actuating drive train of the type having a rocker arm, and a valve biased to the closed position by a spring force and operatively associated with one end of the rocker arm and normally moved a predetermined opening distance in response to a drive means applying a periodic force which normally effects a pivotal movement about the fulcrum of the rocker arm by moving the other end of the rocker arm a given distance, the improved varying means comprises:

resilient means for biasing at least a portion of said rocker arm in a direction counter to said drive means force with a force inferior to said periodic drive means force and said valve spring force; and means associated with said rocker arm and movable between first and second positions, and operative when in said first position to prevent yielding of said resilient means under the force of said drive means to effect normal pivotal movement of the rocker arm in response to said drive means moving said other end of said rocker arm said given distance, and operative when in said second position to allow yielding of said resilient means under the force of said drive means for effecting a change in said pivotal movement when said drive means moves said other end of said rocker arm said given distance and for providing a force in said drive train to maintain driving contact between said drive means and said other end of said rocker arm.

10. The valve drive train of claim 9, wherein non-movement of said rocker arm by said drive means constitutes an inactive period of said rocker arm, and wherein said varying means further includes:

means operative to apply a force which is effective to move said associated means between said first and second positions only when said rocker arm is inactive.

11. The valve drive train of claim 9, further includes at least two of said valve actuating drive trains and each drive train has one of said improved varying means associated therewith and non-movement of said rocker arms by said drive means constitutes an inactive period of said rocker arms, and wherein said improved varying means further include:

means operative to apply a force which is effective to move two of said associated means in unison between said first and second positions only when said rocker arms are inactive.

12. In a machine having improved means varying the amount of valve opening in a valve actuating drive train of the type including a rocker arm having an opening extending therethrough, a valve biased to the closed position by a spring force and operatively associated with one end of the rocker arm and normally moved a predetermined opening distance in response to a drive means applying a force which moves the other end of the rocker arm a given distance, the improved varying means comprises:

a support member fixed at one end to a support structure and extending through the opening transverse to the normal fulcrum of the rocker arm;

fulcrum means slidably disposed about said support member on the thrust side of said rocker arm and presenting a curved surface for the normal pivoting of the rocker arm; and latch means including means movable between first and second positions and operative when in said first position to prevent sliding movement of said fulcrum means, whereby said valve is moved said predetermined opening distance in response to the other end of the rocker arm being moved said given distance, and operative when in said second position to allow sliding movement of said fulcrum means, whereby said predetermined opening distance is varied.

13. The drive train of claim 12 wherein said improved varying means further includes:

resilient means biasing said fulcrum means into engagement with said rocker arm with a force inferior to the forces of said spring and drive means and operative when said movable means is in said second position to provide a force for maintaining driving contact between said drive means and said other end of said rocker arm.

14. A device for selectively disabling and enabling normal opening of valves of an internal combustion engine during engine operation, said device comprising:

first and second means adapted for incorporation into the engine valve drive train, said first means adapted for contacting driving portions of the valve drive train and defining a first abutting means, and said second means defining a second abutting means for contacting said first abutting means and adapted to effect transmittal of periodic valve drive train forces which effect normal opening of the engine valves; and actuation means operative to drivingly interconnect said first and second abutting means to effect normal valve opening and closing and operative to drivingly disconnect said first and second abutting means to effect a disabling of the valves, said actuation means being selectively operative to apply an actuating force effective to drivingly disconnect said second abutting means from said first abutting means upon relaxation of said valve drive train forces and said actuation means being selectively operative to apply an actuating force effective to drivingly connect said second abutting means with said first abutting means only upon relaxation of said valve drive train forces.

15. A device for selectively disabling and enabling while the engine is running an internal combustion engine valve which is normally opened in response to periodic valve drive train forces, said device comprising:

means adapted for incorporation in the engine valve train and defining a driven surface and a reaction surface, said driven surface adapted for contacting driving portions of the valve drive train and said reaction surface adapted to transmit the periodic valve drive train forces for effecting normal valve opening;

two-position means selectively movable between a valve enabling position drivingly interconnecting said surfaces and a valve disabling position drivingly disconnecting said surfaces, said two position means operable upon application thereto of an actuating force and upon relaxation of the valve drive train forces to move from said enabling position to said disabling position and thereupon to provide a lost motion between said surfaces for effecting the driving disconnection of said surfaces and disable the valve during subsequent application of the valve drive train forces, and upon deactuation of said actuating force and only upon relaxation of the valve drive train forces to return to said enabling position and thereupon drivingly interconnect said surfaces and enable the valve for normal opening during subsequent application of the valve drive train forces.

16. A device for selectively disabling and enabling normal opening of valves of an internal combustion engine while the engine is running, said device comprising:

first and second means adapted for incorporation into the engine valve drive train, said first means adapted for contacting driving portions of the valve drive train and including first abutting means, and said second means including second abutting means for contacting said first abutting means and adapted to react valve train driving forces which effect normal opening of the engine valves;

actuation means connected to said second means and selectively operative to apply a force directly to said second means to move said second abutting means into driving interconnection with said first abutting means to effect normal valve opening and closing and selectively operative to apply a force directly to said second means to move said second abutting means out of driving interconnection with said first abutting means to effect a disabling of the valves by allowing relative movement of said abutting means in response to said valve train driving forces; and means for biasing said first abutting means counter to said valve train driving forces and operative when said actuation means moves said second abutting means out of driving interconnection to resiliently absorb said relative movement of said abutting means for preventing clashing of components in said valve drive train.

* * * * *